US007156513B2

(12) United States Patent
Ang

(10) Patent No.: US 7,156,513 B2
(45) Date of Patent: Jan. 2, 2007

(54) INK CARTRIDGE COMPONENT

(75) Inventor: Kian Hin Ang, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 274 days.

(21) Appl. No.: 10/888,326

(22) Filed: Jul. 8, 2004

(65) Prior Publication Data

US 2006/0007280 A1 Jan. 12, 2006

(51) Int. Cl.
*B41J 2/175* (2006.01)
*B41J 2/14* (2006.01)

(52) U.S. Cl. ..... 347/87; 347/50

(58) Field of Classification Search ..... 347/50, 347/86, 87
See application file for complete search history.

(56) References Cited

U.S. PATENT DOCUMENTS 6,053,607 A * 4/2000 Kaplinsky et al. ..... 347/87
6,243,117 B1 * 6/2001 Brandon et al. ..... 347/87
6,332,677 B1 * 12/2001 Steinfield et al. ..... 347/87
6,578,956 B1 * 6/2003 Hosaka ..... 347/86
6,811,250 B1 * 11/2004 Buchanan et al. ..... 347/87

* cited by examiner

*Primary Examiner*—Anh T. N. Vo

(57) ABSTRACT

An ink cartridge component comprises a body member having a sump portion for supporting a print head and a peripheral wall portion extending from the sump portion. The peripheral wall portion and the sump portion define a volume forming an ink chamber of the ink cartridge. A recessed region is defined at a junction between the peripheral wall portion and the sump portion, the recessed region, in use, underlying a carrier carrying the print head. The recessed region facilitates flexing of the carrier when an ink cartridge including the component is inserted into a cradle of an ink cartridge carriage.

8 Claims, 5 Drawing Sheets

INK CARTRIDGE COMPONENT

FIELD

This invention relates generally to ink delivery in a printing device and, more particularly, to an ink cartridge component.

BACKGROUND

An ink printer, in particular, an inkjet printer makes use of a carriage which traverses a medium on which printing is to be effected. The carriage contains an ink cartridge commonly referred to as an "ink pen".

The ink cartridge contains a supply of ink and supports a print head. The print head makes use of an ink ejecting die. Ink is ejected from selected nozzles of the die by means of an actuating mechanism that includes a resistive heating arrangement.

The cartridge is removably received in the carriage whereby electrical connections are made to the actuating mechanism of the cartridge. The electrical connection is effected by way of a plurality of conductors. The conductors engage electrical traces for the actuating mechanism. The traces are carried on a flexible circuit board arranged on an outer surface of the cartridge.

The conductors are pin-shaped and protrude into the carriage. Therefore, insertion of the cartridge into the carriage can result in the conductors damaging the circuit board rendering the cartridge inoperative or causing the cartridge to malfunction.

A secondary consideration is that, if the flexible circuit board is inadequately adhered to the ink cartridge, ink can wick between the cartridge and the flexible circuit board resulting in leakage of ink which can contaminate the carriage and printer.

SUMMARY

An ink cartridge component is disclosed. The ink cartridge component comprises a body member having a sump portion for supporting a print head and a peripheral wall portion extending from the sump portion. The peripheral wall portion and the sump portion define a volume forming an ink chamber of the ink cartridge. A recessed region is defined at a junction between the peripheral wall portion and the sump portion, the recessed region, in use, underlying a carrier carrying the print head. The recessed region facilitates flexing of the carrier when an ink cartridge including the component is inserted into a cradle of an ink cartridge carriage.

DETAILED DESCRIPTION OF EXEMPLARY EMBODIMENT

Figure 1B:
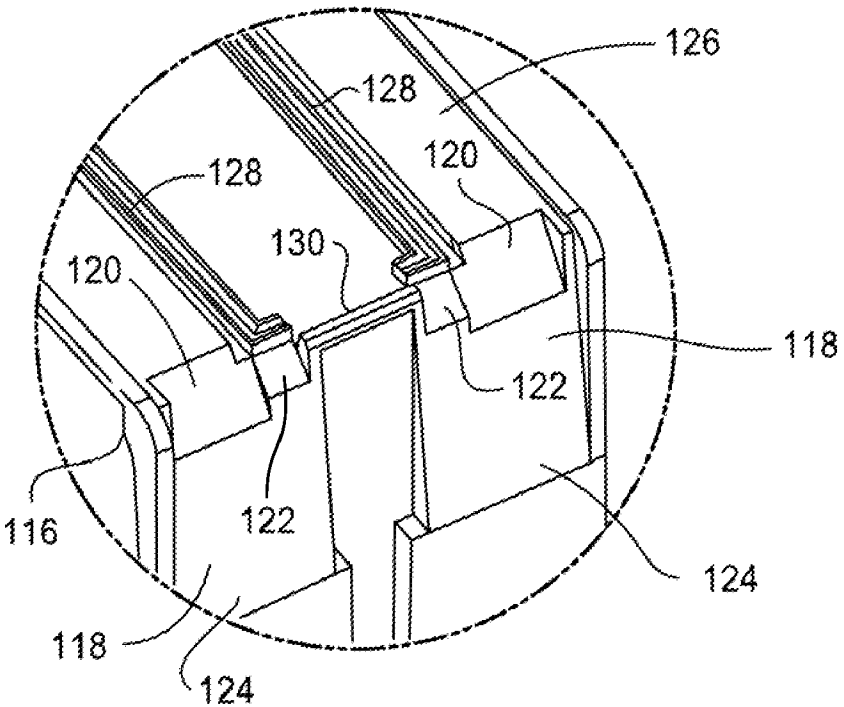
FIG. 1B shows, on an enlarged scale, a three dimensional view of the encircled portion of the component of FIG. 1A.
Figure 1A:
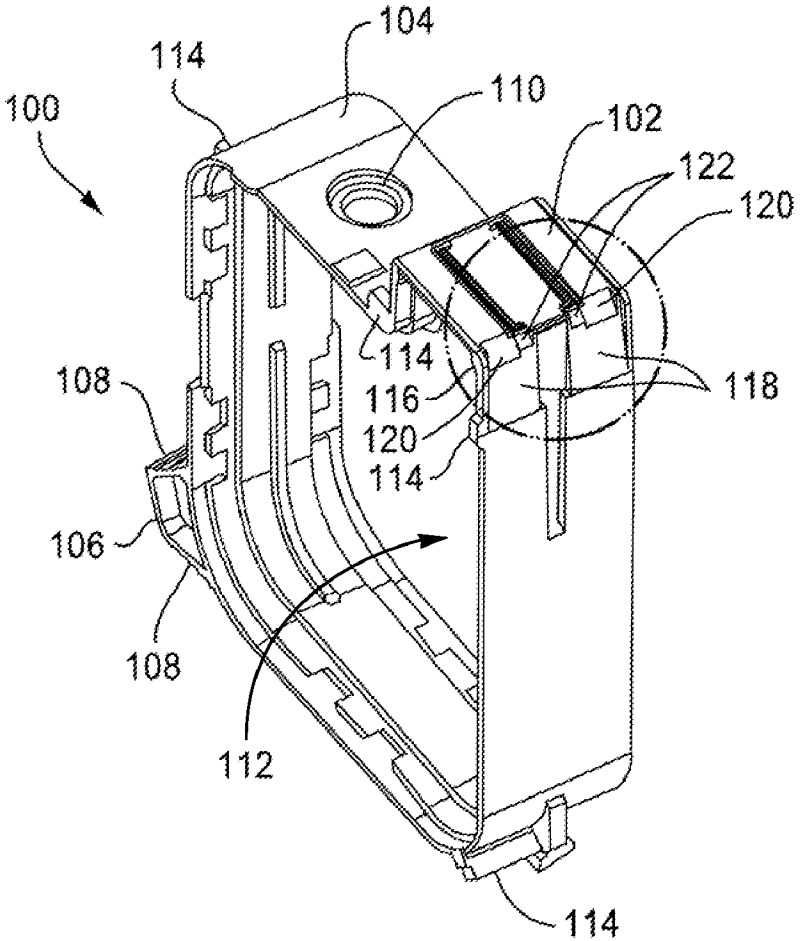
FIG. 1A shows a three dimensional view, from below, of an ink cartridge component in accordance with an embodiment of the present invention.
Figure 1C:
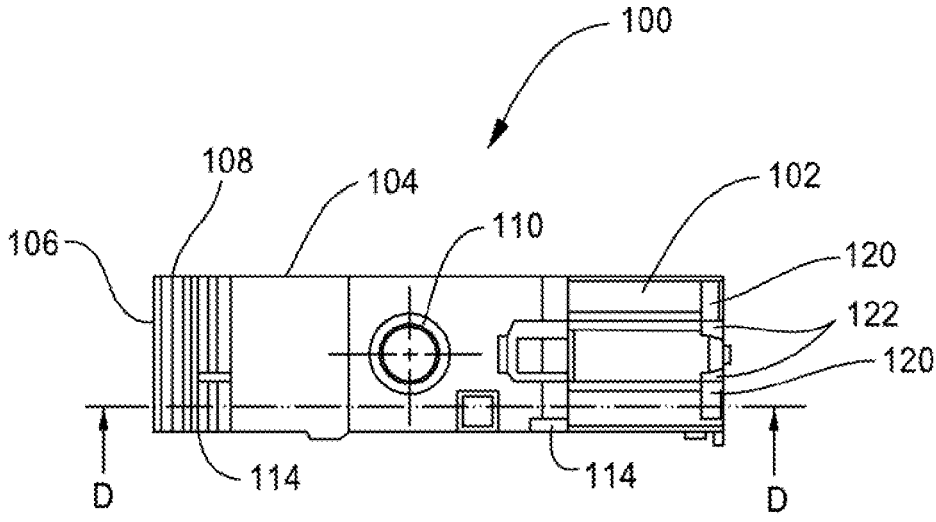
FIG. 1C shows a bottom view of the component.
Figure 1D:
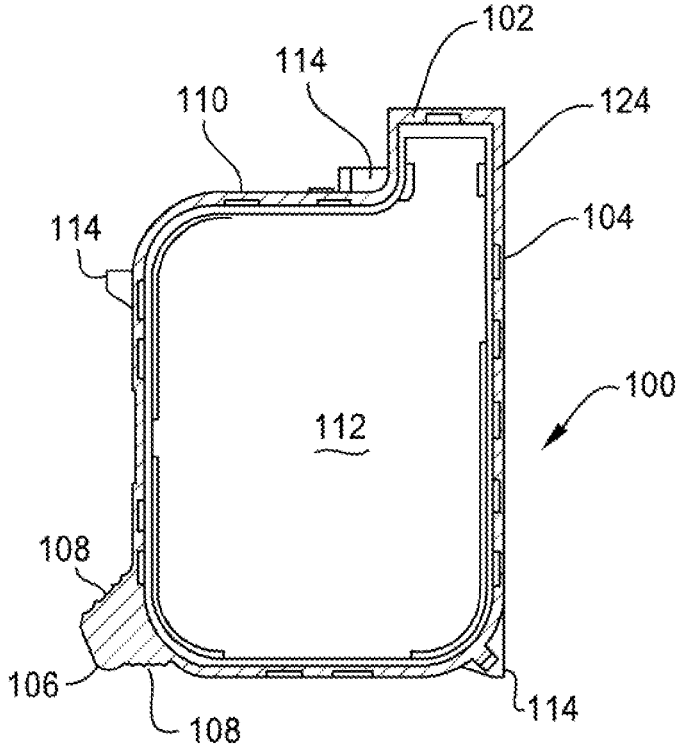
FIG. 1D shows a sectional side view of the component taken along line D–D in FIG. 1C.
Figure 1E:
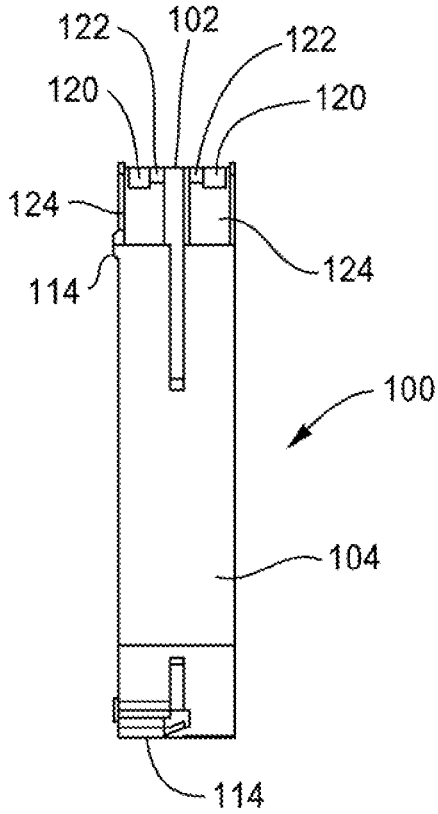
FIG. 1E shows a side view of the component.

FIGS. 1A–1E reference numeral 100 designates an exemplary embodiment of an ink cartridge component. The component 100 has a sump portion 102 formed integrally with a peripheral wall portion 104 as a one-piece molding.

At a region of the component 100 diametrically opposed from the sump portion 102, a nose or handle 106 is formed integrally with the peripheral wall portion 104. The handle 106 has knurled surfaces 108 to facilitate insertion of a cartridge, including the component 100 into a printer carriage (not shown) or the removal of the cartridge from the carriage.

A charging opening 110 is formed in the peripheral wall portion 104 of the component 100. Ink to be dispensed is charged into a chamber 112 (FIG. 1D) via the charging opening 110.

There is a need for the ink cartridge containing the component 100 to be accurately aligned in the carriage. For that purpose, the peripheral wall portion 104 carries datum features 114 to facilitate alignment of the cartridge in the carriage.

A junction 116 is defined between the sump portion 102 and the peripheral wall portion 104 of the component 100. A recessed region 118 is defined at the junction 116 between the sump portion 102 and the peripheral wall portion 104 of the component 100.

As shown in greater detail in FIG. 1B of the drawings, a recessed region 118 is provided on each side of a medial plane bisecting the component 100. Each recessed region 118 includes a first, major chamfer 120 and a second, minor chamfer 122 arranged inwardly of the major chamfer 120.

The major chamfer 120 is provided at the end of a tapering part 124 of the peripheral wall portion 104 where the peripheral wall portion 104 meets the sump portion 102. The sump portion 102 defines a pair of laterally spaced lands 126. A pair of spaced raised formations or ribs 128 are arranged inwardly of the lands 126. Each major chamfer 120 is aligned with one of the lands 126 with each minor chamfer 122 being aligned with one of the ribs 128. A knife edge 130 is arranged between the chamfers 122.

Typically, the included angle between a surface of the sump portion 102 and the major chamfer 120 is of the order of 150 to 160° and, more particularly, about 155°. The included angle between the minor chamfer 122 and the surface of the sump portion 102 is slight greater, typically of the order of about 155 to 165° and, more particularly, about 160°.

In an embodiment, the component 100 is formed by injection molding of a relatively rigid plastics material such as a glass-filled, modified polyphenylene oxide, polysulfone, or other suitable plastics material.

Figure 2:
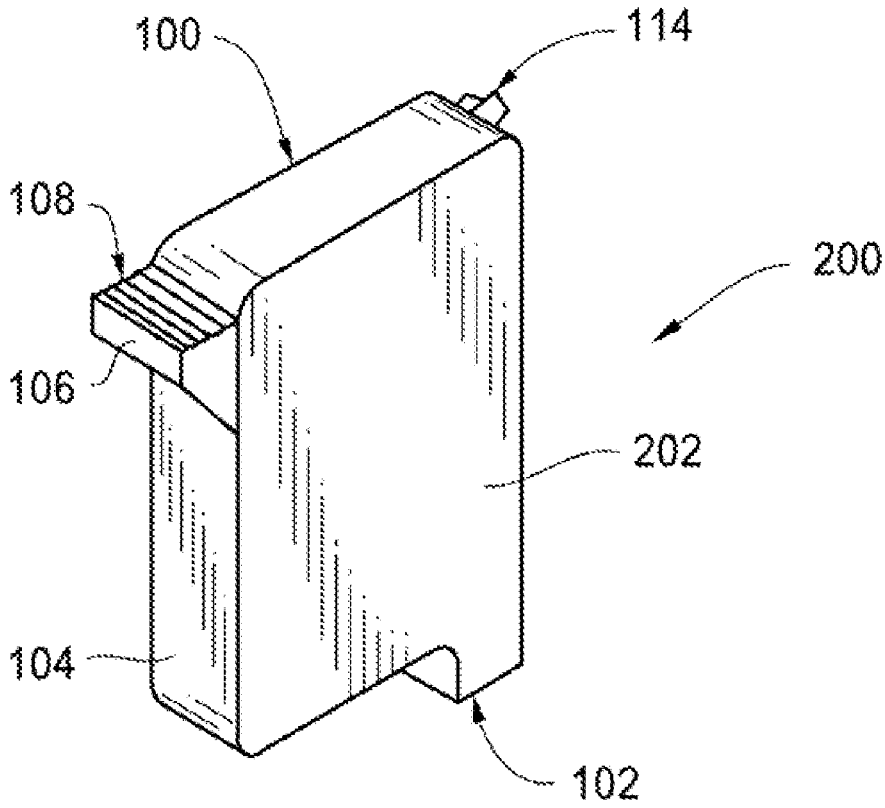
FIG. 2 shows a three dimensional view of an ink cartridge in accordance with an embodiment of the present invention.

Referring to FIG. 2, an ink cartridge 200 includes the component 100. Sides of the cartridge 200 are closed off by side plates 202, one of which is shown in FIG. 2 of the drawings. The component 100 and side plates 202, together, define the chamber 112 in which an ink supply (not shown) is received.

Figure 3:
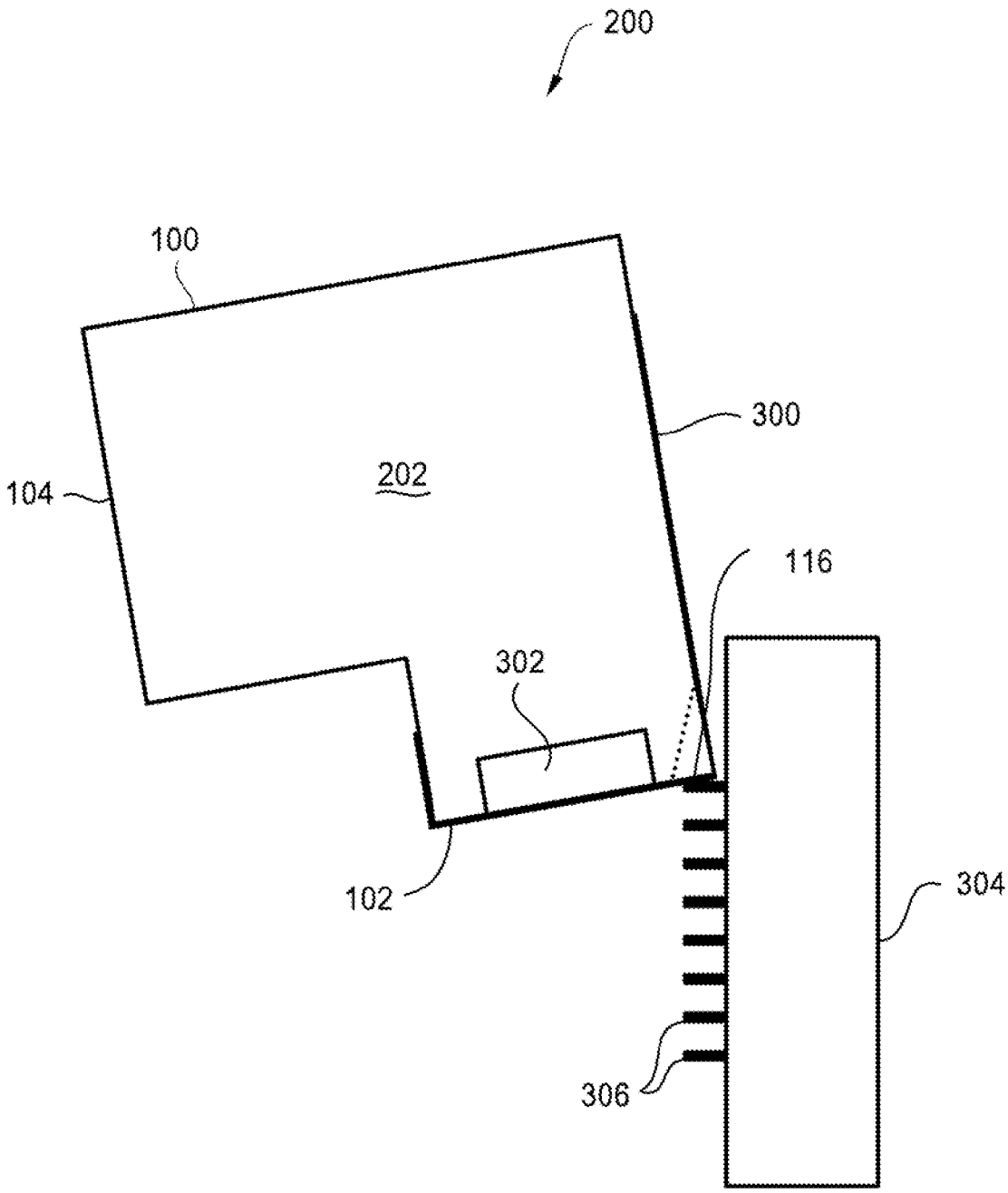
FIG. 3 shows a schematic representation of the insertion of an ink cartridge into a carriage.
Figure 4:
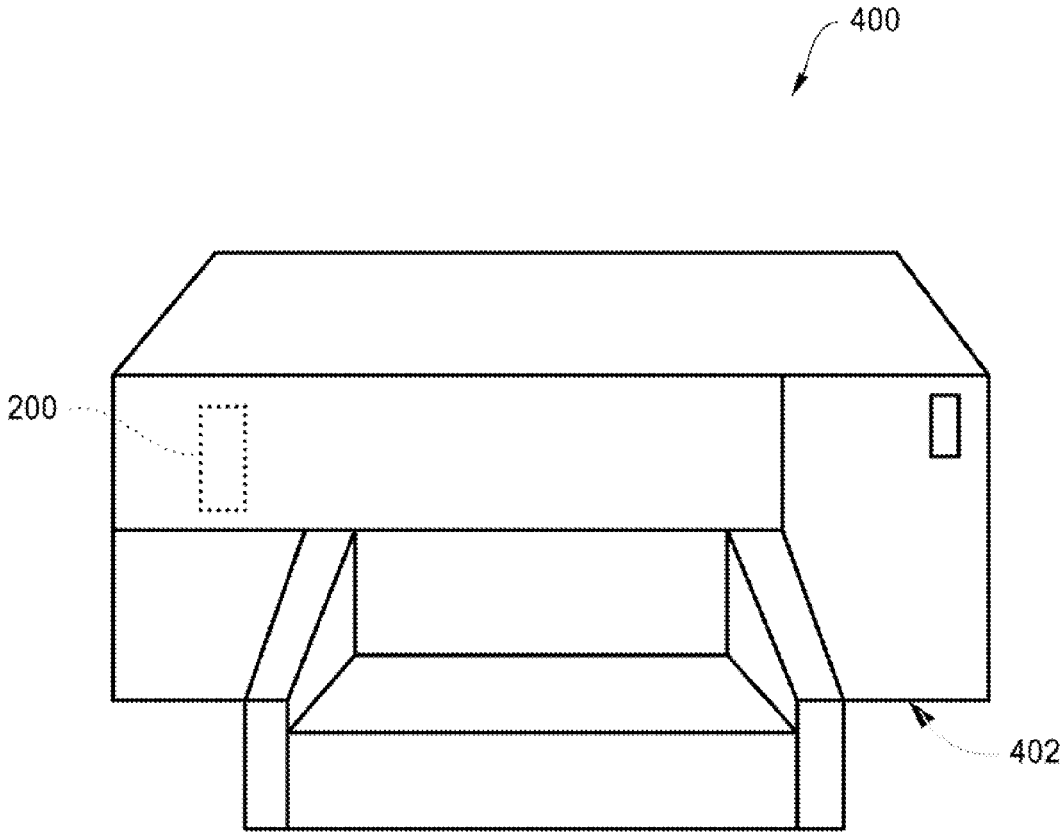
FIG. 4 shows a schematic, perspective view of a printer in accordance with an embodiment of the invention.

Referring to FIG. 3, a carrier in the form of a flexible circuit board or flexible member 300 overlies the sump portion 102 and a part of the peripheral wall portion 104 of the component 100 of the ink cartridge 200. The flexible member 300 supports electrical traces for providing power to an actuating mechanism wherein the actuating mechanism includes a resistive heater arrangement of a print head 302 of the ink cartridge 200.

To supply power to the conductors of the flexible member 300, the carriage includes a carriage block 304 from which a plurality of conductors in the form of pogo pins 306 project. When the cartridge 200 is inserted into the carriage, the possibility exists that the flexible member 300 could snare on the pogo pins 306 resulting in damage to the flexible member 300 rendering the cartridge 200 inoperative or liable to malfunction.

The lands 126 of the component 100 provide surface areas to which the flexible member 300 is adhesively secured. Further, the print head 302 is supported between the ribs 128 of the component 100. The flexible member 300 is also adhesively secured to the ribs 128. The knife edge 130 imparts a sharp bend to the flexible member 300 where it traverses the junction 116.

A printer 400 includes a housing 402. The cartridge 200 is displaceably arranged in the housing 402 to traverse print media on which images are to be printed.

It is an advantage of the invention that an ink cartridge component 100 is provided which provides a recessed region into which the flexible member 300 can be urged upon insertion of a cartridge 200 containing the component 100 into a carriage of the printer 400. In so doing, the likelihood of damage to the flexible member 300 carried by the cartridge 200 is reduced. The risk of failure or malfunction of the cartridge 200 is correspondingly reduced.

A secondary advantage of the invention is that the provision of the recessed regions 118 reduces the incidence of wicking of ink thereby reducing the incidence of unacceptable print quality and contamination of the printer and carriage.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

I claim:

1. An ink cartridge comprising:

a body member having a sump portion and a peripheral wall extending from the sump portion, said sump portion having a top surface for supporting a print head, said peripheral wall including a recessed region formed at a junction between said top surface and said peripheral wall, said recessed region including at least one chamfer, said chamfer forming an obtuse angle with said top surface;

a pair of opposing side wall members, said side wall members, said sump portion and said peripheral wall defining an ink chamber; and a flexible carrier carrying a print head, said flexible carrier overlying the sump portion, the chamfered portion, and the recessed region such that said print head is supported by the top surface of the sump portion, wherein said recessed region facilitates flexing of the carrier when the ink cartridge is inserted into an ink cartridge carriage.

2. The cartridge of claim 1, wherein the recessed region comprises a plurality of chamfered portions, one chamfered portion having a chamfer different from a chamfer of a neighbouring chamfered portion.

3. The cartridge of claim 1, wherein the peripheral wall and the sump portion are substantially symmetrical about a medial plane and a part of the recessed region is arranged on each side of the plane.

4. The cartridge of claim 1, wherein the carrier is a flexible printed circuit board carrying the print head.

5. A printer comprising a housing; and an ink cartridge contained in the housing, the ink cartridge comprising:

(a) a body member having a sump portion and a peripheral wall extending from the sump portion, said sump portion having a top surface for supporting a print head, said peripheral wall including a recessed region formed at a junction between said top surface and said peripheral wall, said recessed region including at least one chamfer that forms an obtuse angle with said top surface;

(b) a pair of opposing side wall members, said side wall members, said sump portion and said peripheral wall defining an ink chamber; and (c) a flexible carrier carrying a print head, said flexible carrier overlying the sump portion, the chamfered portion, and the recessed region such that said print head is supported by the top surface of the sump portion, wherein said recessed region facilitates flexing of the carrier when the ink cartridge is inserted into an ink cartridge carriage.

6. The printer of claim 5, wherein the recessed region comprises a plurality of chamfered portions, one chamfered portion having a chamfer different from a chamfer of a neighbouring chamfered portion.

7. The printer of claim 5, wherein the peripheral wall portion and the sump portion are substantially symmetrical about a medial plane and in which a part of the recessed region is arranged on each side of the plane.

8. The printer of claim 5, wherein the carrier is a flexible printed circuit board carrying the print head.

* * * * *